United States Patent [19]

Whiteley

[11] Patent Number: 4,771,760

[45] Date of Patent: Sep. 20, 1988

[54] METHOD AND APPARATUS FOR BURNING STACKED NEWSPAPERS IN A FIREPLACE

[76] Inventor: Isaac C. Whiteley, 2500 NE. 201 St., Troutdale, Oreg. 97060

[21] Appl. No.: 48,621

[22] Filed: May 11, 1987

[51] Int. Cl.[4] ..... F23H 1/02

[52] U.S. Cl. ..... 126/163 R; 126/165; 126/164; 126/298

[58] Field of Search ..... 126/298, 163 A, 164, 126/163 R, 165, 152 R, 120, 121, 292

[56] References Cited

U.S. PATENT DOCUMENTS

| | | | |
|---|---|---|---|
| 890,669 | 6/1908 | Low | 126/298 |
| 4,129,251 | 12/1978 | Goldsby et al. | 126/121 |
| 4,519,378 | 5/1985 | Mims | 126/165 |
| 4,557,250 | 12/1985 | Kramert | 126/120 |

FOREIGN PATENT DOCUMENTS

| | | | |
|---|---|---|---|
| 1197744 | 12/1985 | Canada | 126/164 |

*Primary Examiner*—James C. Yeung
*Attorney, Agent, or Firm*—Epstein & Edell

[57] ABSTRACT

Method and apparatus for burning stacked newspapers in a fireplace includes a grate having a sloping support for supporting a stack of newspapers at an angle inclined to the horizontal with free edges of the newspapers at the front and air supply directing a flow of air in a substantially horizontal direction at a position above the free edges of the newspapers to supply oxygen to enhance burning and to continuously turn the uppermost pages of the stack of newspapers upward to burn the newspapers page-by-page.

9 Claims, 1 Drawing Sheet

METHOD AND APPARATUS FOR BURNING STACKED NEWSPAPERS IN A FIREPLACE

BACKGROUND OF THE INVENTION

1. Field of the Invention

The present invention pertains to fireplace heating and, more particularly, to apparatus for burning stacked newspapers in a fireplace.

2. Description of the Prior Art

Fireplaces are commonly used for heating and for the pleasant ambiance created by the flames of burning fuel; however, wood, the most frequently used fuel, has become relatively expensive in relation to the amount of heat actually delivered to the room in which the fireplace is located. That is, the efficiency of fireplaces when wood is burned therein is quite low since flames produced by the burning of wood are normally small supplying limited radiant heat to the room and since convection heat is limited due to air being supplied to the fire from the room and escaping up the chimney.

A great amount of effort has been expended to increase the efficiency of fireplaces, such efforts primarily being directed to heating air in the fireplace and forcing the heated air into the room and using less expensive fuels. In particular, many attempts have been made to facilitate the burning of newspapers in fireplaces since newspapers, once read, represent a waste material to be disposed of and, thus, are abundantly available at substantially no cost. In the past, attempts to use newspapers as fireplace fuel have been directed to apparatus for rolling the newspapers to simulate logs; however, stacks of newspapers have not been successfully used as fireplace fuel because oxygen cannot get to the entire stack due to ashes smothering or suffocating the fire. Even when a stack of newspapers is laid flat (horizontal) and air is blown on the stack, only a small portion of the top of the stack of newspapers will burn (about one-half inch) before the fire is extinguished by ash smothering. Accordingly, it will be appreciated that prior art attempts to burn newspapers in a fireplace have had the disadvantages of requiring substantial treatment or handling of the newspapers prior to placing the newspapers in the fireplace such as unfolding and separating newspaper pages and billing up the newspaper pages individually.

SUMMARY OF THE INVENTION

Accordingly, it is a primary object of the present invention to overcome the disadvantages of the prior art by efficiently burning stacked newspapers in a fireplace requiring minimal handling of the newspapers prior to placing them in a fireplace.

Another object of the present invention is to burn stacks of newspapers in a fireplace page-by-page by continuously turning the uppermost pages of the stack with a flow of air thereby creating maximum radiant energy while completely burning the newspapers to increase efficiency and decrease residue exhausted through the chimney.

A further object of the present invention is to support a stack of newspapers on a sloping support at an angle of incline to the horizontal with free edges of the newspapers at the bottom and to direct a substantially horizontal flow of air toward the stack of newspapers above the free edges to continuously turn the uppermost pages of the stack upward to burn the newspapers page-by-page.

The present invention has another object in the burning of newspapers in a fireplace requiring handling of the newspapers only to form a stack with the free edges at one end and placing the stack on a sloping grate in the fireplace.

Some of the advantages of the present invention over the prior art are that newspapers can be burned in a fireplace with minimal handling, the apparatus can be simply and easily installed in most fireplaces, paper is prevented from passing up the chimney and burning is completely producing only a white ash with no sparks or creosote.

The present invention is generally characterized in an apparatus for burning stacked newspapers in a fireplace including a grate having a front end, a rear end and a sloping support extending upwardly from the front end to the rear end for supporting a stack of newspapers at an angle of incline to the horizontal with free edges of the newspapers adjacent the front end and a supply of air disposed adjacent the front end of the grate for directing a flow of air in a substantially horizontal direction toward the sloping support at a position above the lowermost portion thereof whereby the flow of air supplies oxygen to the stack of newspapers to enhance burning and the flow of air continuously turns the uppermost pages of the stack of newspapers upward to burn the newspapers page-by-page.

The present invention is further characterized in a method of burning newspapers in a fireplace including the steps of supporting a stack of newspapers in a fireplace at an angle of incline to the horizontal with free edges of the newspaper disposed at the lowermost position and directing a substantially horizontal flow of air at the stack of newspapers at a position above the free edges to supply oxygen to the newspapers and to turn the uppermost pages of the newspapers upward to continuously burn the newspapers page-by-page.

Other objects and advantages of the present invention will become apparent from the following description of the preferred embodiment taken in conjunction with the accompanying drawings.

DESCRIPTION OF THE PREFERRED EMBODIMENT

Figure 1:
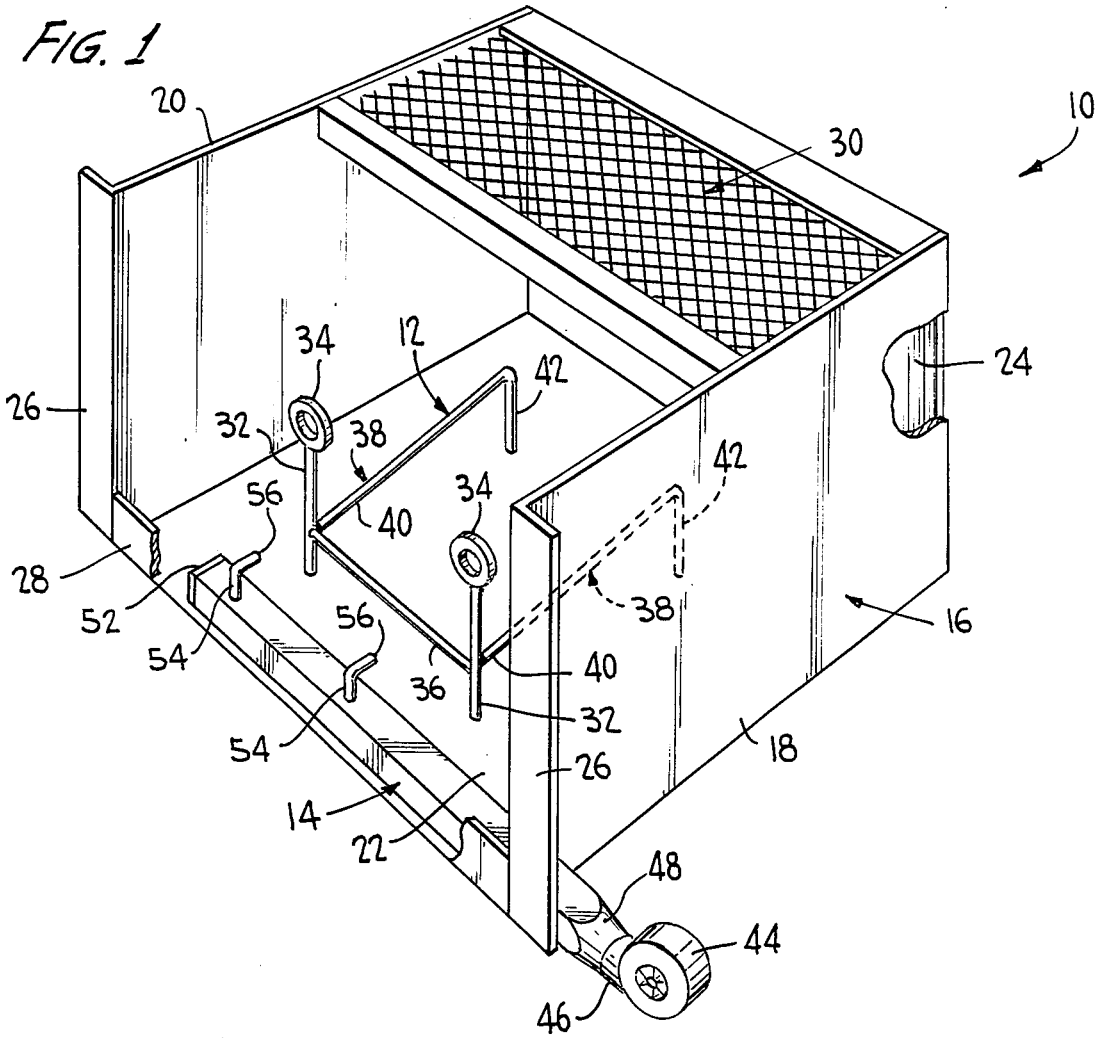
FIG. 1 is a perspective view of apparatus for burning stacked newspapers according to the present invention.
Figure 2:
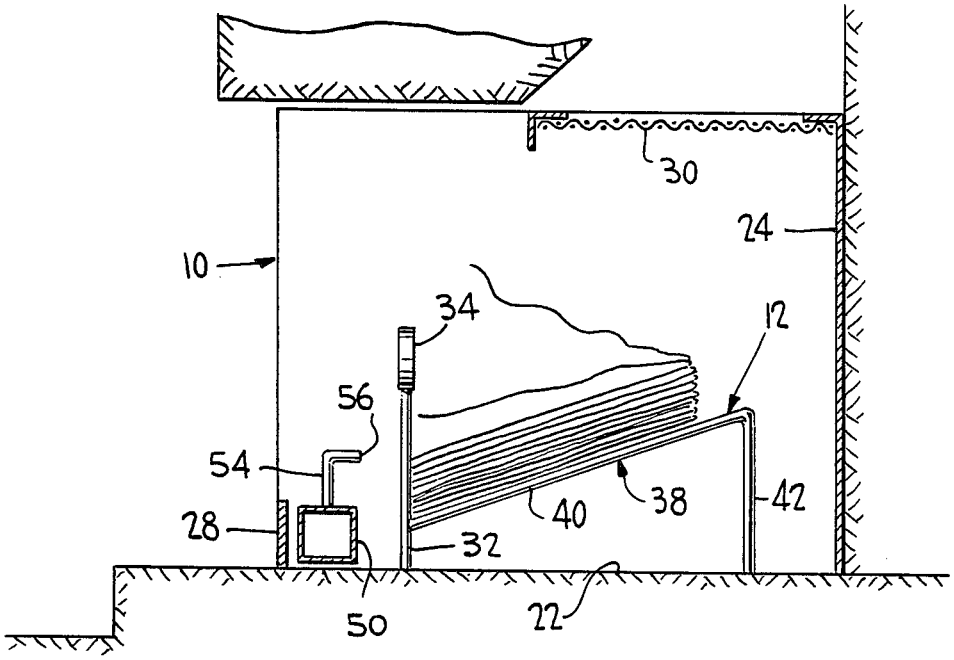
FIG. 2 is a side elevation of the apparatus of FIG. 1 positioned in a fireplace.

Apparatus 10 for burning stacked newspapers according to the present invention is shown in FIGS. 1 and 2 and includes, as basic components, a grate 12, an air supply unit 14 and a firebox 16, the firebox being made of steel and having dimensions to permit the firebox to be positioned in most fireplaces, masonry or zero clearance. To this end, the firebox is made of fourteen gauge steel panels forming opposite side walls 18 and 20 welded at their edges to a floor 22 and a rear wall 24. Flanges 26 are welded to the front edges of the side walls for decorative purposes and can be painted to be color coordinated with a lower panel strip 28 welded to the front edges of the side walls and the floor to extend across the open front of the firebox. A screen assembly 30 is welded to the top edges of the side walls and the rear wall and extends over approximately one-half of the firebox from the rear wall toward the front. The rear wall has a width less than the width of the open front of the firebox to provide an outwardly tapered configuration for the firebox to enhance radiation being directed through the open front. In a specific embodiment, the firebox preferably has a rear width of seventeen inches, a front width of twenty one inches, a depth from front ot rear of fifteen and one-half inches and a uniform height of fifteen inches. The panel 28 has a height of four inches.

The grate 12 is formed of iron and has a pair of parallel, vertical front legs 32 having bottom ends for engaging the floor of the firebox and top ends terminating at enlarged abatement rings 34. A cross bar 36 extends horizontally across the front end of the grate between legs 32, and an L-shaped member 38 extends rearward, upwardly and outwardly from each front leg 32 to the rear end of the grate. Each member 38 is formed of a sloping support arm 40 extending from one front leg at a position spaced above the bottom end of the leg and a vertical rear leg 42 for engaging the floor of the firebox. The height of the rear legs 42 is greater than the spacing of the front ends of the support arms 40 above the floor 22 such that the support arms 40 form a sloping support extending upwardly and rearwardly from the front end of the grate to the rear end of the grate at an angle of incline to the horizontal to support a stack of newspapers to be burned at the same angle of incline with the front edges of the newspapers abutting the legs 32 at the front end of the grate for proper positioning relative to the air supply unit 14. In a specific embodiment, the front legs 32 are spaced by a distance of four inches, the rear legs 42 of members 38 are spaced by a distance of six inches such that the grate is wider at the rear than at the front, the rear legs 42 are spaced from the front legs 32 by a distance of twelve and one-half inches, the rear legs have a height of five and one-half inches and the front ends of the support arms 40 are spaced from the floor by a distance of two inches such that the sloping support formed by the support arms has an angle of incline to the horizontal of 15.64°. The angle of incline should be less than 45° and, preferably is within a range of from 10° to 30°.

The air supply unit 14 includes a fan or blower 44 having a discharge outlet 46 received in an open end 48 of a manifold tube 50 disposed on the floor 22 of the firebox across the front end thereof adjacent panel strip 28 and in front of the grate. The manifold tube 50 has a closed end 52 and, preferably, is square in cross section to prevent movement of the tube. An opening is formed in the side wall of the firebox to permit communication between the manifold tube and the blower, and the blower can be disposed on either side of the firebox and, preferably, is supported directly on the hearth even though additional tubing not shown, can be used if the blower is disposed at a location remote from the firebox. The inlet of the blower can draw room air or outside air, as desired. A pair of small L-shaped tubes 54 extend from the top of manifold tube 50 the tubes 54 having horizontal nozzle portions 56 for directing streams of air in a substantially horizontal direction toward the sloping support at a position above the lowermost ends of the support arms 40. In one embodiment, the blower 44 supplies air at fifteen cfm, the manifold tube is made of steel to be one and one-half inch square and has a length of sixteen inches and the tubes 54 are spaced by a distance of five and three-quarter inches and are made of one-inch diameter copper. In this embodiment, the nozzle portions 56 will supply air streams to the newspapers outside the front legs; however, additional tubes 54 can be provided and the tubes can be positioned at various positions relative to the front end of the grate.

The screen assembly 30 prevents residue from being exhausted up the chimney and, by extending only halfway from back to front, leaves room for flames to pass up into the fireplace rather than leaping forward into the room. The screen assembly is preferably made of three layers, a lower layer of one inch steel mesh, an intermediate layer of one-half inch steel mesh and an upper layer of one-quarter inch steel mesh.

In use, the apparatus 10 of the present invention is placed in a conventional fireplace with the screen assembly 30 aligned with the flue or chimney as shown in FIG. 2. The grate 12 is centered with respect to the air supply tubes 54 making certain that the front legs 32 of the grate do not obstruct the flow of air to the sloping support. Newspapers are simply stacked to have the free edges thereof aligned, and the stack of newspapers is placed on the grate with the free edges of the newspapers disposed lowermost to abut front legs 32. Once the blower 44 is started, air streams from tubes 54 will create a flow of air turning the uppermost pages of the stack of newspapers upward such that the newspapers can be easily lit. The continuous flow of air from tubes 54 will continuously turn the uppermost pages of the newspapers and supply oxygen thereto to create large flames while burning the stack of newspapers page-by-page. By "page-by-page" burning it is meant that pages will be burned individually or in small numbers since more than a single page can be turned upward at any time. The flow of air from the tubes 54 is directed substantially horizontally at the stack of newspapers at a position above the free edges; however, air will also pass below the grate to further supply oxygen for complete burning of the entire stack of newspapers. As shown in FIG. 2, the pages will turn one or more at a time create a substantial blaze that requires no attention once the stack of newspapers is placed on the grate and the fire is started.

The screen 30 will prevent residue from passing up the chimney and will also deflect flames into the body of the firebox which, due to its tapered configuration and continuous sides, will reflect radiant heat into the room. By limiting the portion of the firebox covered by the screen 30, a space is created to allow leaping flames to be maintained within the fireplace.

The apparatus and method of burning newspapers in a fireplace in accordance with the present invention, accordingly, permits stacked newspapers to be burned in a manner to maximize radiant heat and completely burn the newspaper since the flow of air both turns the pages of the newspaper and provides oxygen to the newspaper to enhance the blaze.

In as much as the present invention is subject to many variations, modifications and changes in detail, it is intended that all subject matter disclosed above or shown in the accompanying drawings be interpreted as illustrative and not in a limiting sense.

What is claimed is:

1. Apparatus for burning stacked newspapers in a fireplace comprising grate means having a front end, a rear end and sloping support means extending upwardly from said front end to said rear end for supporting a stack of newspapers at an angle of incline to the horizontal with free edges of the newspapers adjacent said front end; and air supply means disposed adjacent said front end of said grate means for directing a flow of air in a substantially horizontal direction toward said sloping support means at a position above the lowermost portion of said sloping support means whereby said flow of air supplies oxygen to the stack of newspapers to enhance burning and said flow of air continuously turns the uppermost pages of the stack of newspapers upward to burn the newspapers page-by-page.

2. Apparatus for burning stacked newspapers in a fireplace as recited in claim 1 wherein said air supply means includes air blower means, a manifold tube receiving air from said blower means and extending along said front end of said grate means, and a plurality of nozzles each communicating with said manifold tube providing streams of air to form said substantially horizontal flow of air directed toward said sloping support means.

3. Apparatus for burning stacked newspapers in a fireplace as recited in claim 1 wherein said grate means includes spaced, substantially vertically extending, front legs and said sloping support means includes a support member extending rearwardly and upwardly from each of said front legs.

4. Apparatus for burning stacked newspapers in a fireplace as recited in claim 1 and further comprising a firebox having a floor, spaced sidewalls and a rear wall extending upwardly from said floor, a screen extending across the top of said firebox, and an open front end, said grate means and said air supply means being disposed in said firebox.

5. Apparatus for burning stacked newspapers in a fireplace as recited in claim 4 wherein said screen extends over only a portion of said firebox.

6. Apparatus for burning stacked newspapers in a fireplace as recited in claim 4 wherein said air supply means includes a manifold tube extending along said open front end of said firebox and blower means for forcing air through said manifold tube and nozzle means extending from said manifold tube to direct a flow of air in a substantially horizontal direction toward said sloping support means.

7. Apparatus for burning stacked newspapers in a fireplace as recited in claim 1 wherein said angle of incline to the horizontal is within the range of from 10° to 30°.

8. Apparatus for burning stacked newspapers in a fireplace as recited in claim 1 wherein said angle of incline is less than 45°.

9. Apparatus for burning stacked newspapers in a fireplace as recited in claim 1 wherein said flow of air directed by said air supply means is additionally directed under said grate means to enhance burning of the newspapers.

* * * * *